US005556308A

United States Patent [19]

Brown et al.

[11] Patent Number: 5,556,308

[45] Date of Patent: Sep. 17, 1996

[54] BLADE FOR PRINTED CIRCUIT BOARD TO ACCESS 120V AC OUTLET CURRENT

[75] Inventors: Donald C. Brown, Freehold; N. Steven Dwarica, Toms River; Suzanne V. Hickey, Brick, all of N.J.

[73] Assignee: Heyco Stamped Products, Inc., Toms River, N.J.

[21] Appl. No.: 480,826

[22] Filed: Jun. 7, 1995

Related U.S. Application Data

[63] Continuation-in-part of Ser. No. 480,827, Jun. 7, 1995, which is a continuation-in-part of Ser. No. 428,492, Apr. 27, 1995, abandoned.

[51] Int. Cl.[6] ..... H01R 13/04; H01R 13/432

[52] U.S. Cl. ..... 439/746; 439/82; 439/884

[58] Field of Search ..... 439/82, 84, 444, 439/736, 746–749, 870, 872, 884

[56] References Cited

U.S. PATENT DOCUMENTS

| | | | |
|---|---|---|---|
| Des. 263,822 | 4/1982 | Smith | D 13/160 |
| 3,391,384 | 7/1968 | Hughes | 439/76.1 |
| 3,631,373 | 12/1971 | Martrias . | |
| 3,685,001 | 8/1972 | Krafthefer . | |
| 3,711,819 | 1/1973 | Matthews . | |
| 3,795,889 | 3/1974 | Nauman et al. . | |
| 3,846,741 | 11/1974 | Kunkle et al. | 439/746 |
| 4,037,898 | 4/1977 | Guyette . | |
| 4,164,071 | 8/1979 | Kruzich . | |
| 4,220,393 | 9/1980 | Ammon et al. . | |
| 4,363,529 | 12/1982 | Loose | 439/82 |
| 4,530,553 | 7/1985 | Aujila | 439/80 |
| 4,618,209 | 10/1986 | Sonobe | 439/395 |
| 4,790,958 | 11/1988 | Shaffer | 29/874 |
| 4,798,935 | 1/1989 | Pezaris | 219/272 |
| 4,915,637 | 4/1990 | Ogawa et al. | 439/76.2 |
| 4,939,623 | 7/1990 | Equi et al. | 361/752 |

OTHER PUBLICATIONS

IBM vol. 5. No. 5, Oct. 1962 Disclosure Bulletin.

*Primary Examiner*—Neil Abrams
*Attorney, Agent, or Firm*—Auslander & Thomas

[57] ABSTRACT

The present invention is a metal blade formed of folded strips (13, 14) for an assembly of electrically conductive contacts in a printed circuit board, adapted to access line current, such as in a 120 V AC outlet. The assembly may be used in various ways such as an intermediate in the making of molded plugs. The blades are adapted for fabrication in a progressive stamping operation and for automation in use from a roll or hopper. A blade of the present invention has resilient tabs (21) and spaced away sharp edge fingers (16). The tabs are formed to snap engage in a tapered slot (26) in a printed circuit board with the sharp edges (17) of the fingers (16) in electrical contact with a printed circuit and to hold its engagement even before being soldered. Each of the folded strips includes pad (12) and a section of a bubble (15) formed to prevent flashing of plastic during a molding process.

11 Claims, 4 Drawing Sheets

FIG.1
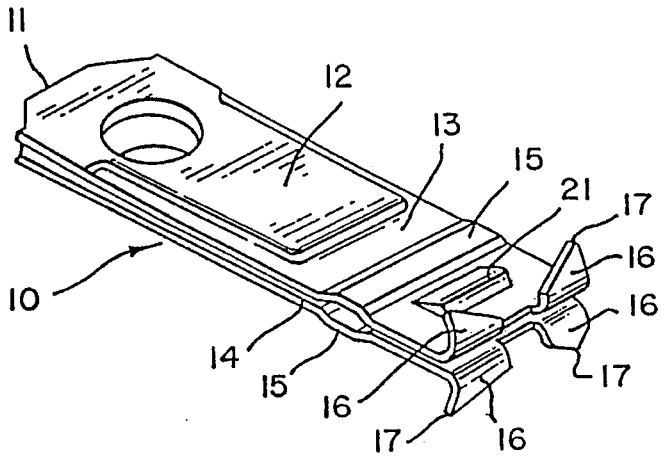
FIG.2
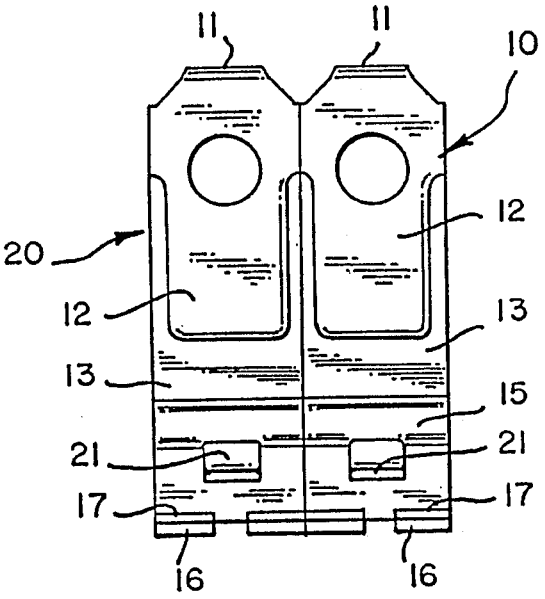
FIG.3
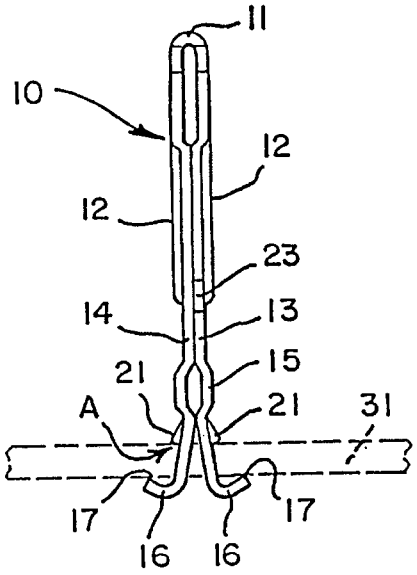
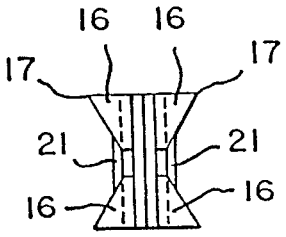
FIG.4

FIG.5
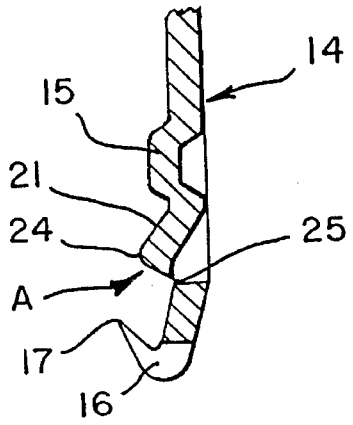
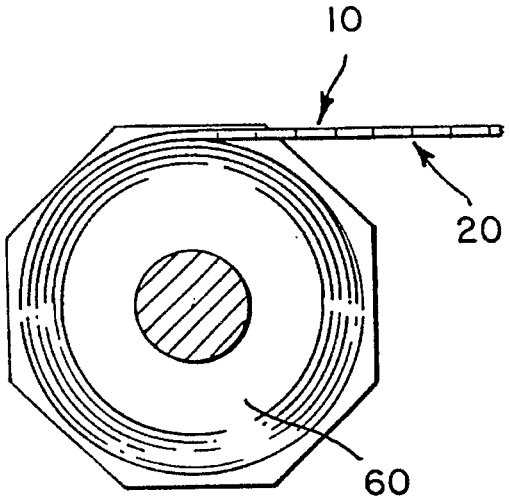
FIG.12
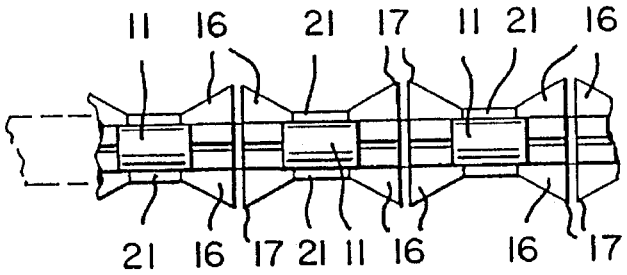
FIG.13

FIG.6
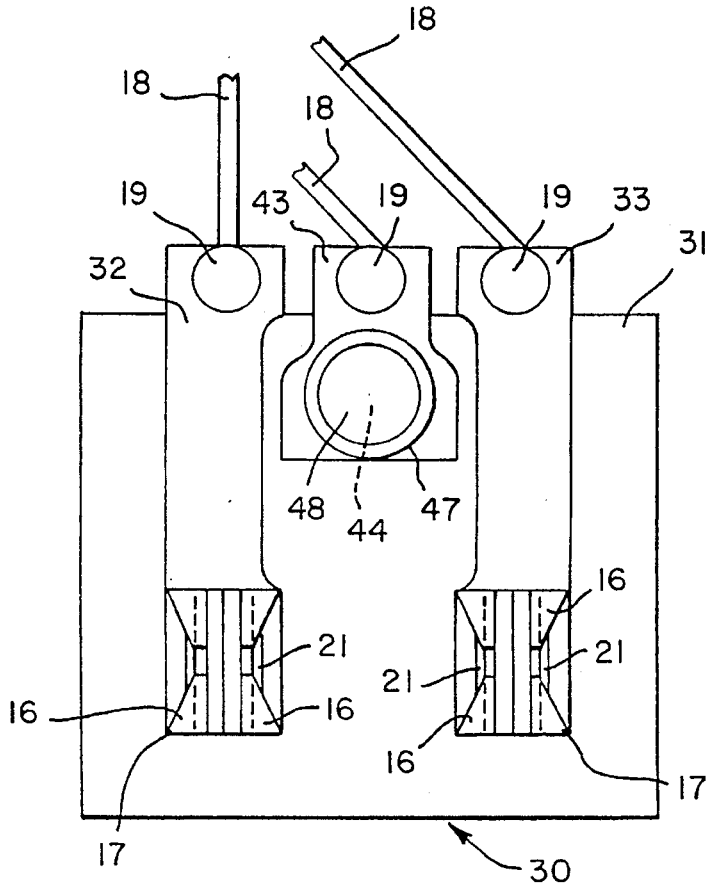
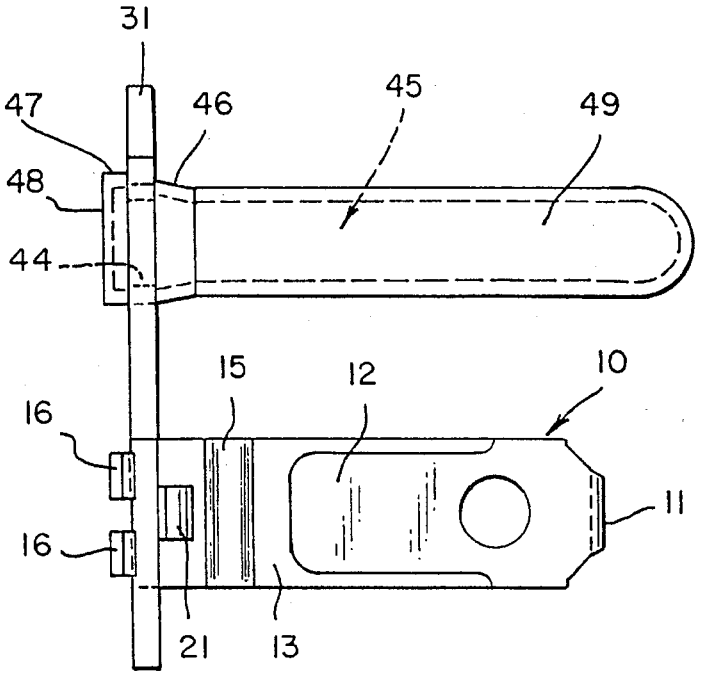
FIG.7

FIG.9
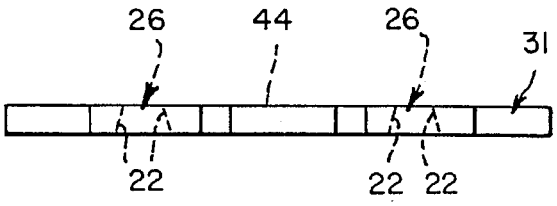
FIG.10
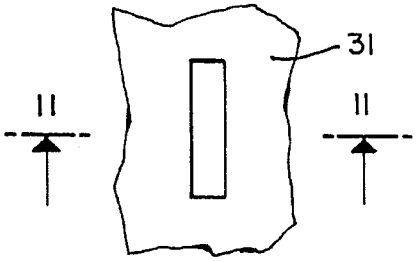
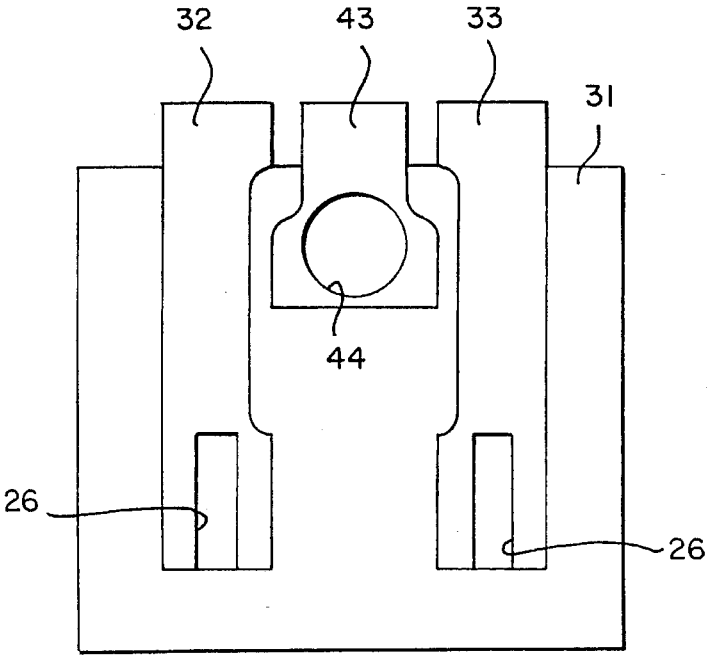
FIG.8
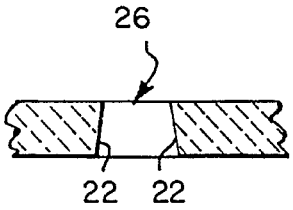
FIG.11

BLADE FOR PRINTED CIRCUIT BOARD TO ACCESS 120V AC OUTLET CURRENT

The present invention is a continuation in part of application Ser. No. 08/480,827 filed Jun. 7, 1995 entitled Assembly Of Conductive Contacts And A Printed Circuit Board For Accessing 120 V AC Outlet Current which is a continuation in part of application Ser. No. 08/428,492 filed Apr. 27, 1995, abandoned, entitled Assembly Of Conductive Contacts And Circuit Board Printed For 120 V AC Current.

BACKGROUND OF THE INVENTION

1. Field of the Invention

The present invention is a contact blade adapted for an assembly of electrically conductive contacts in a printed circuit board, adapted to access line current, such as in a 120 V AC outlet. The assembly may be used in various ways, such as an intermediate in the making of molded plugs, in a transformer for rechargeable units, night lights, low voltage surge protectors and resistance heaters for room fresheners.

The blade is a low cost padded thin-line, 0.020 thick metal which snaps and locks into a phenolic printed circuit board. The blade is flow solderable to a printed circuit on the printed circuit board. The blade includes a seal-off bubble for PVC overmolding, which prevents flashing of the contacts and prevents the padded shape at the front of the blade from popping open, which may happen in production. The blade has a four point dig-in contact area to assure contact and the positioning of the blade and is adapted for automation.

The blade is blanked so that lanced tabs are formed on both sides of the blade to lock the blade into the printed circuit board.

Printed circuit boards are not generally connected into the standard 120 V AC current outlets directly, nor indirectly.

The printed circuit board with blades engaged can be moved automatically, or moved as a unit for further operations.

The blades can be continuously stamped from conductive metal stock for assembly by an insertion machine or hopper fed for machine or manual insertion. In an assembly with a printed circuit board the blades can be directly electrically connected to a 120 V AC electrical outlet.

2. Description of the Related Art

The prior art discloses many different variations of snap in devices for printed circuit boards per se.

WO 86/07204 discloses a complex terminal for soldering to a printed circuit board. The terminal has a spring like finger to maintain touching contact with the board and to form a reliable solder joint for surface mounting an electrical connector with floating electrical terminals. The connectors are spring loaded and legs are received in holes to anchor the connector independently of solder tails.

U.S. Pat. No. 4,992,056 discloses a surface mount electrical connector for mounting on a circuit board. The connector includes terminals (38) which have solder tails (66) for soldering to a printed circuit board.

U.S. Pat. No. 4,037,898 discloses an electrical connector blade which snap fits into a printed circuit board for making an electrical connection. The blade contact extends horizontally on the longitudinal plane of the circuit board. The blade has legs at a right angle to the blade to connect the blade to the board along the plane of the board and in electrical contact with the board. A special recess along the length of the blade compensates for variations in the board and/or the blade in order to maintain electrical contact. The blade is not adapted for 120 V AC connectivity.

U.S. Pat. No. 4,915,637 discloses a wiring device which is retained in slots on the printed circuit board. A through terminal is perpendicularly mounted to a printed circuit board through a special straddling connector.

U.S. Pat. No. 4,220,393 discloses a stamped electrical connector which is seated and held by sleeves in an insulator.

U.S. Pat. No. 4,530,553 discloses a minimum force insertion connector which is housed in slots in a plug. The terminals are exemplary of solder connected terminals substantially parallelly connected to a printed circuit board.

U.S. Pat. No. 3,685,001 discloses an electrical terminator assembly having opposed contact arms and a central U-shaped body portion. The terminals, while perpendicular to their base, are not self supporting in the openings through which they pass.

U.S. Pat. No. 4,618,209 discloses perpendicularly attached lead members for a printed circuit board where the leads have a removable interlink for the purpose of positioning the lead in the printed circuit board. The leads are then soldered into the printed circuit board.

U.S. Pat. No. 3,711,819 discloses female terminals attachable to a printed circuit board by passing tabs through openings in the circuit board and having the tabs bent over and soldered to the circuit board conductors on the underside of the board.

U.S. Pat. No. 3,631,373 discloses a round electrical pin for printed circuit board typical of prior art conventional pins and contacts in printed circuit boards.

U.S. Pat. No. 4,780,958 discloses another round electrical pin for printed circuit board typical of prior art conventional pins and contacts in printed circuit boards.

U.S. Pat. No. 3,795,889 discloses another round electrical pin for printed circuit board typical of prior art conventional pins and contacts for printed circuit boards.

U.S. Pat. No. 4,363,529 discloses another type of contact for printed circuit board typical of prior art conventional contacts for printed circuit boards.

U.S. Pat. No. 4,798,935 discloses a 120 V AC system to be plugged into a conventional outlet with a circuit to a aroma generating apparatus.

U.S. Pat. No. 4,164,071 discloses a printed circuit board having die stamped conductive patterns having integral terminals by folding conductive material.

U.S. Pat. No. 4,939,623 discloses at blades for a 120 V AC outlet extending from a transformer for a printed circuit board.

U.S. Pat. No. 3,391,384 discloses another type of blade for a 120 V AC outlet extending from a printed circuit board with a transformer.

U.S. Design Pat. No. 263,822 discloses a round pin and contact blades extending from a flat surface.

IBM disclosure Bulletin Vol. 5, No. 5 of October, 1962 discloses a miniature pluggable contact having a folded midsection with opposing formed prongs 11 positioned to receive a pin 10. Barbs 14 are formed on the sides to lock the connector in place. The contact stem is molded into the printed circuit board and/or held there by barbs to hold it in place.

Annexed hereto is form PTO-1449 and copies of the patents cited therein.

SUMMARY OF THE INVENTION

The present invention is a blade for an assembly of electrically conductive contacts in a printed circuit board adapted to access line current such as in a 120 V AC outlet. The assembly may be used in various ways, such as an intermediate in the making of molded plugs, in a transformer for rechargeable units, night lights, low voltage surge protectors and resistance heaters for room fresheners.

The blades are engagable through slots in the printed circuit board, holding themselves perpendicular to the board, flow solderable and in electrical contact with a printed circuit and/or a conductor. The slots in the printed circuit board are preferably adapted to guide the blades to slide into a snap position to be engaged. Once the blades are engaged, the printed circuit board may then be, for instance, molded into a plug without the need of staking or special load bars in the mold.

The making of the blades can be automated on a conventional stamping strip and be provided in rolls, which can then be used in an automated insertion step, inserting the blades into the printed circuit board. The blades can also be automatically stamped, and in a successive step, be inserted directly into the printed circuit board. The use of folded metal, padded thin blades is a cost saving made possible by the present invention.

The blades preferably include a bubble, so that in a molding process, the bubble serves as a dam to stop the unwanted flow of molding plastic.

According the present invention, a stamped metal blade can access electric outlet line current when in an assembly of a printed circuit board having at least two electric contact blades. The blades are securely engagable with the printed circuit board in electrical contact with a printed circuit. The blade has a first fold and a second fold defining a first end of the blade. Each fold is apposed and has a length, a pad, a portion of a bubble, a tab tapering outward and a second end including fingers. The pad extends on a plane along the length of the blade, toward, but not including the bubble portion. The blade has a thickness along a plane; the thickness is defined by the pads. The bubble portions are athwart the blade on the plane and are substantially the thickness of the blade. The fingers are resilient and extend substantially perpendicularly outwardly beyond the thickness with a slight inclination inward toward the first end. The fingers have sharp ends. The tabs include an end. The tab ends and the fingers are spaced apart substantially a distance equal the thickness of the printed circuit board.

The electric outlet line current may be 120 volt AC current. The tab may be lanced from the folds. The fingers may be substantially triangular and may extend from a base at the fold and have an apex defining the sharp ends.

A stamping strip of blades has blades, which can access electric outlet line current when in an assembly of a printed circuit board, having at least two electric contact blades. The blades are securely engagable with the printed circuit board in electrical contact with a printed circuit. Each blade in the stamping strip has a first fold and a second fold defining a first end of the blade. Each fold is apposed and has a length, a pad, a portion of a bubble, a tab tapering outward and a second end including fingers. The pad extends on a plane along the length of the blade, toward, but not including the bubble portion. The blade has a thickness along a plane, the thickness is defined by the pads. The bubble portions are athwart the blade on the plane and are substantially the thickness of the blade. The fingers are resilient and extend substantially perpendicularly outwardly beyond the thickness with a slight inclination inward toward the first end. The fingers have sharp ends. The tabs include an end. The tab ends and the fingers are spaced apart substantially a distance equal the thickness of the printed circuit board. Each blade is joined at shear point.

The electric outlet line current may be 120 volt AC current. The tab may be lanced from the folds. The fingers may be substantially triangular and may extend from a base at the fold and have an apex defining the sharp ends. The stamping strip may be in the form of a roll.

Although such novel feature or features believed to be characteristic of the invention are pointed out in the claims, the invention and the manner in which it may be carried out, may be further understood by reference to the description following and the accompanying drawing.

BRIEF DESCRIPTION OF THE DRAWING

FIG. 1 is an isometric view of the blade of the present invention.

FIG. 2 is a top plan view of a stamping strip showing two blades of FIG. 1.

FIG. 3 is a side elevation view of FIG. 2 showing a printed circuit board in phantom.

FIG. 4 is a bottom plan view of FIG. 3.

FIG. 5 is an enlarged broken away sectional detail of FIG. 3 at arrow A.

FIG. 6 is an elevation view of the bottom of a wired assembly with a printed circuit board with blades of the present invention to access 120 V AC outlet current and including a round pin.

FIG. 7 is a right side elevation view of FIG. 6

FIG. 8 is an elevation view of the bottom of the printed circuit board of FIG. 6 including slots for blades and an opening for a round pin.

FIG. 9 is a top plan view of FIG. 8.

FIG. 10 is an elevation detail of the top of a blade slot of FIG. 8.

FIG. 11 is a blown up detail of FIG. 10 at lines 11—11.

FIG. 12 is a continuous stamping strip of blades on a roll.

FIG. 13 is an enlarged detail of the stamping strip of blades shown in FIG. 12 as it comes off the roll.

Referring now to the figures in greater detail, where like reference numbers denote like parts in the various figures.

DESCRIPTION OF THE PREFERRED EMBODIMENTS

The blade 10, as shown in FIGS. 1–5, is folded metal and preferably made in a progressive stamping on a stamping strip 20 as shown in FIG. 2. The blade 10 has an end 11, a first fold 13, a second fold 14, a bubble 15, a tab 21 and a second end portion including fingers 16. The first fold 13 and second fold 14 include fingers 16. The first fold 13 and second fold 14 each include a pad 12. The fingers 16 each have a sharp end 17. As can be seen in FIG. 3 the blade 10 has a shear point 23.

As shown enlarged in FIG. 5 the tab 21 has a rounded portion 24 and a burr 25.

The elements of the blade 10 are interactive with an assembly 30 as shown in FIGS. 6–11, which comprises a printed circuit board 31 with a first circuit 32, a second circuit 33 and a third circuit 43. As can best be seen in FIGS. 8–11, the printed circuit board 31 has a blade slot 26. As can best be seen in FIGS. 9 and 11, the slots 26 have tapered walls 22.

The printed circuit board 31, as shown in FIGS. 6 and 8, has a round pin opening 44 which passes through the printed circuit board 31 and the third circuit 43.

The assembly 30, as shown in FIGS. 6 and 7, includes the printed circuit board 31, wires 18 are soldered to first circuit 32, second circuit 33 and third circuit 43 with spot solder 19. Blades 10 are engaged in the slots 26. As shown in FIGS. 6 and 7 the fingers 16 engage the first circuit 32 and second circuit 33, respectively.

A round pin 45 is engaged in the pin opening 44, in contact with the third circuit 43.

As can best be seen in FIG. 7, the round pin 45 has a tapered flange 46, which engages the printed circuit board 31 on the top side and a round flange 47, which engages the printed circuit 43 on the bottom side. As can be seen in FIG. 6, the round pin 45 has an integral end cap 48 within the pin 45, set back from the round flange 47 which enfolds it.

As can be been in FIG. 12 an elongated stamping strip 20 of blades 10 may come on a conventional roll 60 for the convenience of delivery or for use in automated procedures.

Operation

The blade 10 is progressively stamped. A stamping strip 20 of two blades 10 is shown in FIG. 2. The advantage of the stamping strip 20 is that the insertion of blades 10 in the printed circuit board 31 of an assembly 30 can be automated.

Each blade 10 has a first fold 13 and second fold 14 extending from the end 11. The blades 10 include pads 12. The pads 12 provide the thickness to the blade 10 equal to a solid blade but with the economy of allowing the use of less metal, thinner metal stock yet providing a rigid, strong metal blade 10.

The bubble 15 is at a prospective mold line. When a blade 10 is engaged in a printed circuit board 31 for instance, it may have to be molded in order to make a molded plug, a transformer for rechargeable units, night lights, low voltage surge protectors or resistance heaters for room fresheners. The bubble 15 prevents the flashing of plastic in the molding process.

The length of the blade 10, for standards such as UL®, is determined from the bubble 15 to the central opening near the blade end 11.

The assembly 30, as shown in FIGS. 6 and 7, which is an operational integration of the printed circuit board 31 with blades 10, which pass through the printed circuit board 31 of the assembly 30, the first circuit 32 and the second circuit 33.

As shown in FIGS. 9 and 11 the slots 26 have tapered walls 22. The tapered walls 22 act as guides to facilitate the putting together the assembly 30, such as by the automated insertion of the blade 10 inserted from a roll or coiled stamping strips 60 shown in FIG. 12, with the end 11 of a blade 10 entering the slot 26 is guided by the tapered walls 22.

As can be seen in FIG. 3 a blade 10 separated from a stamping strip 20 is cut at a shear point 23.

Blades 10 include fingers 16 at one end. The fingers 16 are upwardly sloped toward the end 11 of the blade 10 that enters into the slot 26. The fingers 16 have sharp ends 17 that assure electrical contact with the respective first circuit 32 and second circuit 33. The fingers 16 are resilient and bear against the printed circuits 32, 33 on the printed circuit board 31, biased in the snap engagement with the printed circuit board 31, so that the sharp ends 17 assure good electrical contact. The printed circuit board 31 is also biased against the tab 21 so that there is no play between the blades 10 and the printed circuit board 31. Good electrical contact with the printed circuits 32, 33 is further assured by flow soldering the fingers 16 with their sharp ends 17 engaged.

The tabs 21 on the blades 10 are tapered and spaced away from the fingers 16 a distance about equal to the thickness of the printed circuit board 31. The tabs 21 are resilient, so that when the blades 10 are inserted through the slots 26 there is a snap engagement with the sharp ends 17 of the fingers 16 in electrical contact with the respective first circuit 32 and second circuit 33. Once engaged, the blades 10 hold firmly and perpendicularly to the printed circuit board 31 and are solderable, particularly flow solderable to insure electrical contact integrity and physical security in the printed circuit board 31.

The lanced tab 21 is shown in FIG. 5 lanced from the metal of the blade 10. The lancing resiliently separates the tab 21 from the metal of the blade 10 substantially without a space between the body of the blade 10. The lancing provides a radius, a rounded portion 24, on the outside of the tab 21 and a burr 25 on the bottom of the tab 21. The lancing maintains the tab 21 rigid, yet flexible to allow the tapered walls 22 to ride over the tab 21, to engage the printed circuit board 31 between the rounded portion 24 and the burr 25 and held by the fingers 16, with the sharp ends 17 engaging the circuits 32 and 33 in the other side of the circuit board 31.

The conductor wires 18, joined to the first circuit 32 and second circuit 33 by the spot solder 19, lead off to do their selected tasks.

The assembly 30 as shown in FIGS. 8 and 9, shows a pin opening 44, in the third circuit 43 which enables a round pin 45 to be engaged in the printed circuit board 31 in electrical contact with the third circuit 43.

The round pin 45 includes a tapered flange 46, tapering outward from the shank 49 of the round pin 45, outwardly sloped toward the end of the round pin 45 that contacts the third circuit 43. The tapered flange 46 acts as a ratchet, to engage the round pin 45 in the pin opening 44 on the printed circuit board 31, between the tapered flange 46 and the round flange 47 in electrical contact with the third circuit 43 and solderable in the printed circuit board 31.

The tapered flange 46 on the pin opening 44 is spaced away from the tapered flange 46 a distance about equal to the thickness of the printed circuit board 31. The tapered flange 46 is sufficiently resilient, so that when the round pin 45 is inserted through the pin opening 44, there is a snap engagement in electrical contact with the third circuit 43. Once engaged, the round pin 45 holds firmly and perpendicularly to the printed circuit board 31 and is flow solderable, to insure the electrical contact integrity and security in the printed circuit board 31.

The blades 10 are adapted for fabrication in a progressive stamping operation and for automation in the use from a roll or hopper. A blade 10 of the present invention has resilient tabs 21 and spaced away fingers 16 to snap engage in a slot 26 in a printed circuit board 31 in electrical contact with a printed circuit 32, 33 and to hold its engagement even before being soldered.

The blade 10 is adapted to be engagable in a conventional 120 V AC outlet receptacles opening (not shown) once engaged in a printed circuit board 31.

The terms and expression which are employed are used as terms of description; it is recognized, though, that various modifications are possible.

It is also understood the following claims are intended to cover all of the generic and specific features of the invention herein described, and all statements of the scope of the invention which, as a matter of language, might fall therebetween.

Having described certain forms of the invention in some detail, what is claimed is:

1. A stamped metal blade to access electric outlet line current in an assembly of a printed circuit board and at least two electric contact blades securely engaged with said printed circuit board in electrical contact with a printed circuit, each said blade having a first fold and a second fold, said folds defining a first end of said blade, each fold apposed to the other one; having a length; a pad; a portion of a bubble; a tab tapering outward; and a second end including fingers, said pad extending on a plane along said length toward but not including said bubble portion, said blade having a thickness along said plane, said thickness defined by said pads, said bubble portions athwart said blade on said plane and being of substantially the thickness defined by said pads; said fingers being resilient; extending substantially perpendicularly outwardly beyond said thickness; and with a slight incline inward toward said first end, said fingers including sharp ends, said tab including an end, and said tab end and said fingers spaced apart substantially a distance equal to the thickness of said printed circuit board.

2. The invention of claim 1 wherein said electric outlet line current is 120 volt AC current.

3. The invention of claim 1 in wherein said tab is lanced from said fold.

4. The invention of claim 1 wherein said fingers are substantially triangular.

5. The invention of claim 4 wherein said triangular fingers extend from a base at said fold and have an apex, said apex defining said sharp ends.

6. A stamping strip of metal blades to access electric outlet line current in an assembly of a printed circuit board and at least two electric contact blades securely engaged with said printed circuit board in electrical contact with a printed circuit, each said blade having a first fold and a second fold, said folds defining a first end of said blade, each fold apposed to the other one; having a length; a pad; a portion of a bubble; a tab tapering outward; and a second end including fingers, said pad extending on a plane along said length toward but not including said bubble portion, said blade having a thickness along said plane, said thickness defined by said pads, said bubble portions athwart said blade on said plane and being of substantially the thickness defined by said pads, said fingers being resilient; extending substantially perpendicularly outwardly beyond said thickness; and with a slight incline inward toward said first end, said fingers including sharp ends, said tab including an end, said tab end and said fingers spaced apart substantially a distance equal to the thickness of said printed circuit board, and each said blade joined at shear point.

7. The invention of claim 6 wherein said electric outlet line current is 120 volt AC current.

8. The invention of claim 6 in wherein said tabs are lanced from said fold.

9. The invention of claim 6 wherein said fingers are substantially triangular.

10. The invention of claim 9 wherein said triangular fingers extend from a base at said fold and have an apex, said apex defining said sharp ends.

11. The invention of claim 6 wherein said stamping strip is in the form of a roll.

* * * * *

UNITED STATES PATENT AND TRADEMARK OFFICE

CERTIFICATE OF CORRECTION

PATENT NO. : 5,556,308

DATED : September 17, 1996

INVENTOR(S) : Donald C. Brown, et al

It is certified that error appears in the above-identified patent and that said Letters Patent is hereby corrected as shown below:

Col. 3, line 25, after "a" first occurrence, before "bubble", insert -- seal off --

Signed and Sealed this

Third Day of December, 1996

Bruce Lehman

*Attest:*

BRUCE LEHMAN

*Attesting Officer*

*Commissioner of Patents and Trademarks*